United States Patent [19]

Ditzig

[11] Patent Number: 4,821,812

[45] Date of Patent: Apr. 18, 1989

[54] DOWN HOLE DRILL IMPROVEMENT

[75] Inventor: Joseph R. Ditzig, Portland, Pa.

[73] Assignee: Ingersoll-Rand Company, Woodcliff Lake, N.J.

[21] Appl. No.: 243,167

[22] Filed: Sep. 8, 1988

Related U.S. Application Data

[63] Continuation of Ser. No. 75,185, Jul. 13, 1987, abandoned, which is a continuation of Ser. No. 811,778, Dec. 20, 1985, abandoned.

[51] Int. Cl.[4] ..... E21B 1/06

[52] U.S. Cl. ..... 173/17; 173/73; 173/137

[58] Field of Search ..... 173/17, 73, 132, 137, 173/138; 91/234; 92/85 B; 175/92

[56] References Cited

U.S. PATENT DOCUMENTS

| | | | |
|---|---|---|---|
| 4,030,554 | 6/1977 | Kammerer, Jr. et al. | 173/17 |
| 4,084,646 | 4/1978 | Kurt | 173/17 |
| 4,530,407 | 7/1985 | Rear | 173/17 |
| 4,530,408 | 7/1985 | Toutant | 173/17 |

*Primary Examiner*—Frank T. Yost
*Assistant Examiner*—Hien H. Phan
*Attorney, Agent, or Firm*—Walter C. Vliet

[57] ABSTRACT

A fluid impact tool is disclosed of the type commonly known as a down-the-hole drill for drilling of rock. The improvement herein described increases deep hole drill performance by providing a means for accumulating piston return air in a traveling air pocket found on the piston. This effectively increases the piston front end volume so as to decrease the effect of the front end air cushion and thereby increase impact. This is particularly effective during operation with increased back pressure such as found in deep holes.

7 Claims, 2 Drawing Sheets

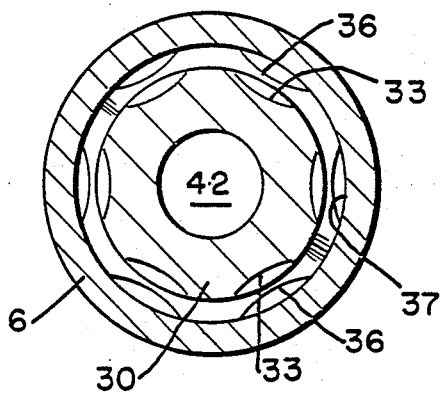
FIG. 3
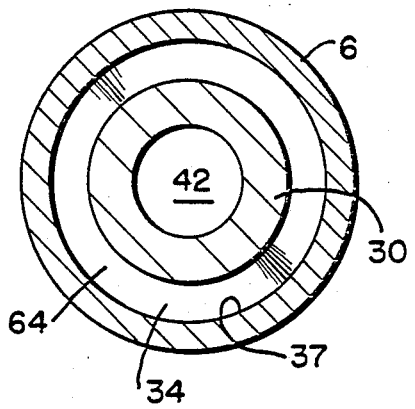
FIG. 6
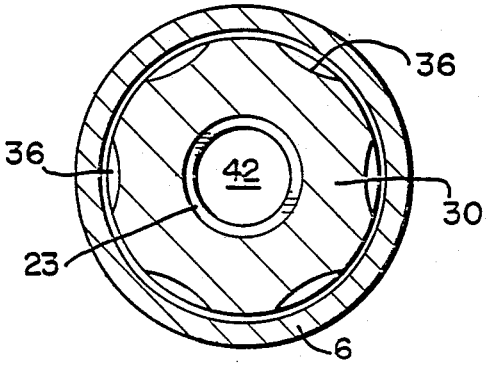
FIG. 4
FIG. 5
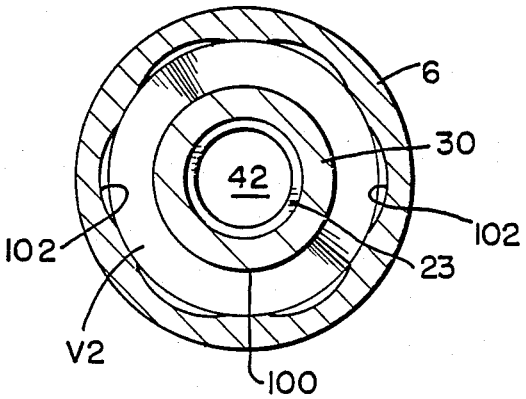

DOWN HOLE DRILL IMPROVEMENT

This application is a continuation of application Ser. No. 07/075,185, filed July 13, 1987 abandoned, which is a continuation of Ser. No. 06/811,778 filed Dec. 20, 1985 abandoned.

BACKGROUND OF THE INVENTION

Down-the-hole drills are generally known in the art. One such drill has been shown and described in U.S. Pat. No. 4,084,646 issued to Ewald H. Kurt and assigned to Ingersoll-Rand Company. The drawings and specifications of that patent are hereby incorporated by reference to describe the basic drill and similar drills to which the present invention applies.

OBJECT OF THE INVENTION

An object of the invention is to increase the effective volume in front of the impact piston without increasing the diameter of the drill.

A further object of this invention is to reduce the effective back pressure developed on the impact piston of a down-the-hole drill in order to improve its deep hole work output.

Yet a further object of this invention is to provide an impact piston with a reduced diameter section forming an accumulator of pressure fluid which travels with the piston without biasing the piston in directions of travel.

Another object of the present invention is to provide a down-the-hole drill with increased work output at higher back pressures experienced in deep holes without increasing the diameter of the drill.

These and other objects are obtained in a percussive drill apparatus of the valveless type comprising:

a casing; a backhead disposed at the back end of the casing adapted to connect the drill apparatus to a drill string and a source of pressure fluid; a distributor disposed within the casing towards the back end of the casing; a percussive member disposed at the front end of the casing to form a chamber having a back end disposed towards the distributor and a front end disposed towards the percussive member between the distributor and the percussive member within the casing; a cylinder sleeve disposed in the chamber toward the back end of the chamber; a first pressure fluid passage formed between the casing and the cylinder sleeve to connect the pressure fluid source to the chamber; a piston disposed in the chamber to reciprocate axially therein and impart a blow on the percussive member; the piston being in sliding contact with the cylinder sleeve adjacent the back end of the chamber and in sliding contact with the casing adjacent the front end of the chamber; a means for continuously applying pressure fluid to a selected portion of the back end of the piston to thereby provide a continued driving force on the piston towards the front end of the chamber; a means for alternately supplying and exhausting pressure fluid to a selected portion of one side of the piston disposed towards the back end of the chamber and to a selected portion of the other side of the piston disposed towards the front end of the chamber to thereby reciprocate the piston; the means for alternately supplying and exhausting pressure fluid to the back side of the piston includes a second pressure fluid passage extending from the first pressure fluid passage along the interior of the sleeve and the exterior of the piston;

The improvement comprising:

A means for accumulating additional pressure fluid in a portion of the piston dispersed towards the front end; and a means for communicating the means for accumulating additional pressure fluid with the first pressure fluid passage.

BRIEF DESCRIPTION OF THE DRAWINGS

FIG. 3 is a cross sectional view of the prior art rock drill taken at section 3—3 shown on FIG. 1.

FIG. 4 is a cross sectional view of the rock drill according to the prior art taken at section 4—4.

FIG. 5 is a cross sectional view of the rock drill according to the present invention taken at section 5—5.

FIG. 6 is a cross sectional view of the rock drill according to the present invention taken at section 6—6.

DESCRIPTION OF THE PREFERRED EMBODIMENT

The drawings are numbered to correspond with similar parts in U.S. Pat. No. 4,048,646 for easy identification and comparison. However, for purposes of understanding this invention it is necessary to know that, in a conventional down hole drill and similar reciprocating hammer devices driven by a pressurized gas, when the pressure fluid enters the area in front of the piston on its down stroke it restrains the piston. If this occurs prior to piston impact as it does in the referenced patent, it reduces the maximum obtainable impact.

In the referenced valveless design some overlap or early introduction of pressure fluid in the frontal area is required for the cycles to operate effectively and the present invention is directed at reducing the restraining effect prior to impact. I have determined that one way this may be accomplished is to effectively increase the volume associated with the frontal area of the impact piston. Since this volume must be pressurized a greater flow of pressure fluid is required to effect the same back pressure. Since the flow of pressure fluid is to some degree restricted by limitation of design in down-the-hole drills this results in an effective time delay in reaching full pressure below the piston. The delay results in increased piston impact while retaining the overlap required for the cycle to operate. The above is particularly effective where as in a deep hole, the exhaust back pressure is substantial and the frontal area pressure is therefore already relatively high.

Figure 1:
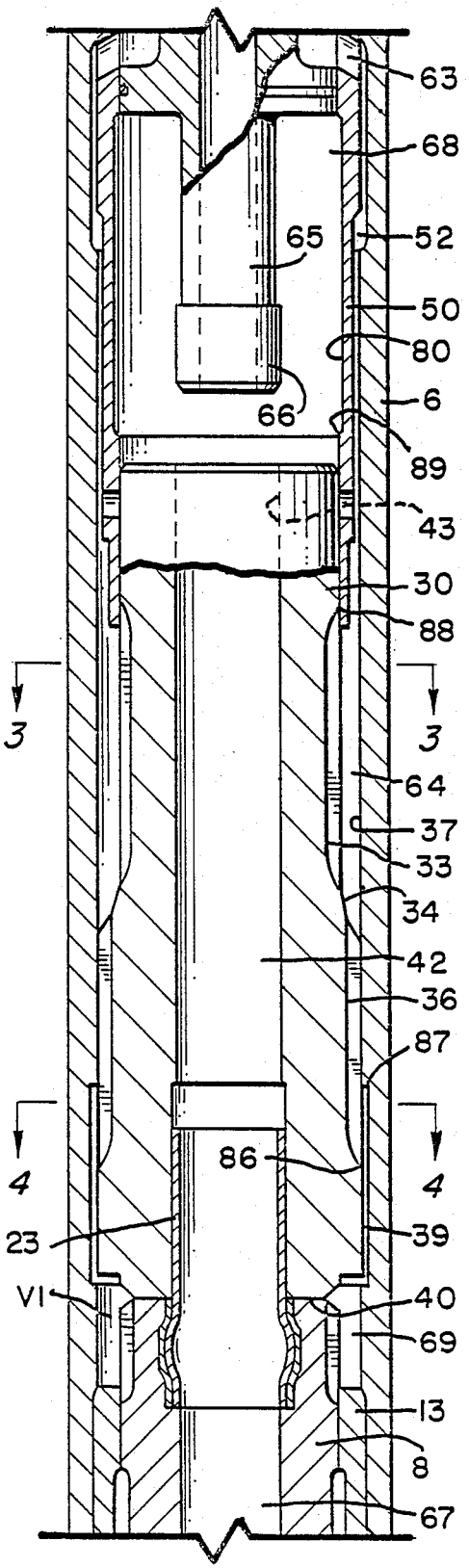
FIG. 1 is a longitudinal section of the center portion of a pneumatic down-the-hole rock drill according to the prior art.

Referring to FIG. 1 a rock drill longitudinal section is shown to illustrate the concerned parts of a down-the-hole pneumatic drill according to U.S. Pat. No. 4,048,646.

Briefly, in this pneumatic drill the air passes through the drilled ports 63 in the cylinder sleeve 50 into an annular passageway 52 between the outside diameter of the cylinder sleeve 50 and the inside of the casing 6.

From here the air moves forward into chamber 64 between the piston outside surface and the casing 6 inside diameter. This is an "air reservoir space" because there is always pressure fluid in this chamber and it is from here that the air passes either to the upper chamber 68 of the piston or the lower chamber 69 of the piston. With the piston in its lower position (shown in FIG. 1 which it would attain before the air is turned on, the air passes into the lower chamber 69, exerting a force on the lower impact imparting surface 40 of the piston 30, driving it upwards towards its one or inlet end. The air continues to feed into the lower chamber 69 or V1 and is trapped between the piston 30, the bit 8, the casing 6 and a spacer ring 13 until the lower sealing surface 37 of the casing, that is, until edge 86 contacts shoulder 87. When this occurs, air is shut off to the lower chamber 69. The piston continues to move upwards, however, by virtue of its velocity and expansion of the air in the lower chamber. As the piston rises, the lower sealing surface of the axial bore 42 of piston 30 pulls off the end of the exhaust tube 23. At this point, the air in the lower chamber 69 exhausts it to the drill bit 8 and out into the exhaust bore 67.

While this is going on at the lower end of the piston, other events are occurring at the upper end. The first is that the upper chamber 68 is sealed off as the sealing surface 43 of the piston axial bore engages the lower end of the enlarged head 66 of the exhaust rod 65 of the distributor. Shortly thereafter, pressure fluid is admitted, via axial porting slots 33, into the upper chamber 68 as edge 88 of the piston slots 36 uncover the shoulder 89 of the undercut 80 inside the cylinder sleeve 50. The air entering the upper chamber 68 first stops the piston on its upwards travel (about an inch from hitting the distributor) and then reverses the piston travel, pushing it forward at increasing velocity. The pressure fluid flow to the upper chamber 68 is shut off as edge 88 of the piston slots 36 cover the shoulder 89 of the undercut 80. From this point on, the piston is driven by expanding pressure fluid. When sealing surface 43 loses contact with enlarged head 66 of the distributor exhaust rod, air in the upper chamber 68 is exhausted through the piston 30, into the exhaust tube 23 and out the bit 8 as the piston continues to move towards its impact on other end, edge 86 of the lower sealing surface 39 of the piston 30 loses contact with the shoulder 87 of internal surface 39 of the casing again at which point air re-enters the lower chamber 69. Shortly thereafter, the piston 30 impacts against the bit 8. The piston rebounds somewhat. This, plus the air re-entering the lower chamber, starts the next cycle.

As can be appreciated by one skilled in the art once the edge of the lower sealing surface 39 loses contact with the shoulder 87 and air begins to enter the lower chamber, the piston 30 begins to loose velocity as a result of the force of such air action on the lower impact surface 40 of the piston. This results in energy loss and it is therefor desirable to minimize the pressure developed in chamber 69.

Figure 2:
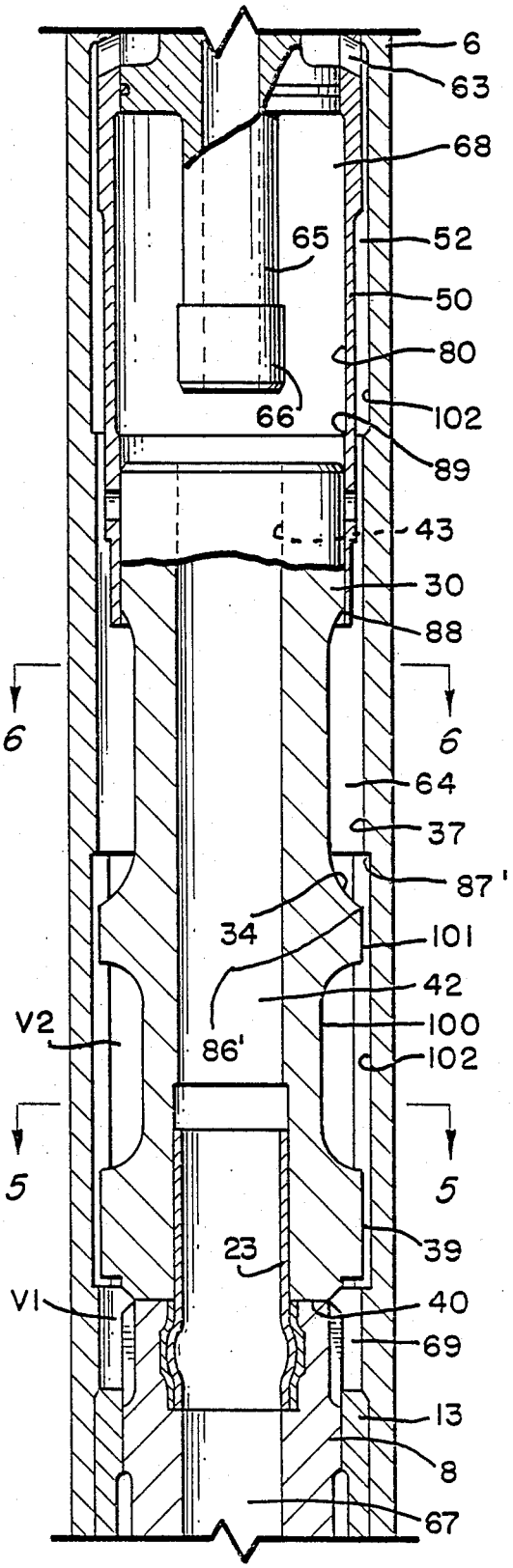
FIG. 2 is a longitudinal section of the center portion of a pneumatic down-the-hole rock drill according to the present invention.

The pressure build up in chamber 69 has been substantially reduced by the present invention. As shown in FIG. 2 the piston 30 is provided with a substantial circumferential undercut 100 which forms a substantial volume V2 for the accumulation of pressure fluid. Shoulder 34 of the prior art device has been extended outward to form an upper circumferential sealing surface 101 of the same diameter as lower circumferential sealing surface 39.

The casing internal fluted longitudinal passages 102 have been extended to perform the same function, at shoulder 87' in cooperation with edge 86' of upper sealing surface 101, as edge 86 performed with shoulder 87 in the prior art and at the approximate same point in cycle timing.

FIGS. 3 and 6 compare the cross sections taken at sections 3—3 and 6—6 respectively in FIGS. 1 and 2.

FIGS. 4 and 5 compare the cross sections through the piston at sections 4—4 and 5—5 respectively in FIGS. 1 and 2. These clearly show the reduced piston diameter in FIG. 5 which forms volume V2.

It can now be appreciated by one skilled in the art that, once the upper sealing surface 101 loses contact with shoulder 87', in order for pressure to build up the pressure fluid or air must fill both volume V1 and V2. With a given available flow of air the total pressure build up is time delayed thereby substantially reducing the retarding force on the piston and dramatically increasing the impact of the piston on the bit.

The results have been most impressive particularly in deep holes where the back pressure or exhaust already reduces piston impact and where the slightly increased air flow resulting for the increased front end volume is of benefit air cleaning the hole.

Having described my invention numerous modifications will now occur to one skilled in the art and I do not wish to be limited in the scope of my invention except as claimed.

I claim:

1. An improved percussive drill apparatus of the valveless type adapted for downhole drilling comprising:

a casing;

a backhead disposed at the back end of said casing adapted to connect the drill apparatus to a drill string and a source of pressure fluid;

a distributor disposed within said casing towards said back end of said casing;

a percussive member disposed at the front end of said casing to form a chamber having a back end disposed towards said distributor and a front end disposed towards said percussive member between said distributor and said percussive member within said casing;

a cylinder sleeve disposed in said chamber toward said back end of said chamber;

a first pressure fluid passage formed between said casing and said cylinder sleeve to connect the pressure fluid source to said chamber;

a piston disposed in said chamber to reciprocate axially therein and impart a blow on said percussive member; said piston being in sliding contact with said cylinder sleeve adjacent said back end of said chamber and in sliding contact with said casing adjacent said front end of said chamber;

a means for continuously applying pressure fluid to a selected portion of said back end of said piston to thereby provide a continued driving force on said piston towards said front end of the chamber;

a means for alternately supplying and exhausting pressure fluid to a selected portion of one side of said piston disposed towards said back end of said chamber and to a selected portion of the other side of said piston disposed towards said front end of said chamber to thereby reciprocate said piston;

said means for alternately supplying and exhausting pressure fluid to said back side of said piston includes a second pressure fluid passage extending from said first pressure fluid passage along the interior of said sleeve and the exterior of said piston.

the improvement comprising:

a nonporting means on the piston in constant communication with said front end of said piston during operation for accumulating additional pressure fluid; and a means for selectively communicating said means for accumulating additional pressure fluid with said first pressure fluid passage.

2. The improved percussive drill according to claim 1 wherein:

said non porting means for accumulating substantial additional pressure fluid comprises a circumferential undercut in the portion of said piston in sliding contact with said casing.

3. The improved percussive drill according to claim 1 wherein:

said means for communicating said non porting means for accumulating additional pressure fluid comprises a longitudinal passage along the internal wall of said casing.

4. An improved percussive apparatus comprising a casing;

a coupling means disposed at one end of said casing for connecting said apparatus to a source of pressure fluid;

a percussive means disposed at the other end of said casing for receiving an impact and imparting the impact to a work media;

a piston disposed in said casing to reciprocate therein intermediate said coupling means and said percussive means and thereby impart an impact on said percussive means;

said piston having a first portion facing towards said one end and a second portion facing towards said one end;

a porting means cooperating with said piston for continuously pressurizing said first portion of said piston and for alternately pressurizing said second portion of said piston and the end of said piston means facing towards said percussive means to thereby cause said piston to reciprocate;

said piston is a stepped piston having a lesser diameter forming the second portion of the piston located towards one end and a greater diameter located towards the other end connected by a land defining a shoulder forming the first portion of the piston between the diameters;

said piston cooperates with a finger valve at its one end and an exhaust tube at its other end to effect pressurization and exhaust at alternate ends of said piston, the improvement consisting of:

a nonporting recess in the peripheral surface of the other end of said piston and in constant communication during operation with the other end of the piston for accumulating pressure fluid alternately supplied to the other end of said piston and thereby retarding the pressure buildup associated with timing overlap on the other end of said second portion of said piston and thereby increase impact on said percussive means.

5. The improved percussive apparatus of claim 4 wherein:

said recess is a circumferential undercut on said piston.

6. The improved percussive apparatus of claim 5 wherein:

said circumferential undercut divides said piston greater diameter portion into an upper circumferential sealing surface and a lower circumferential sealing surface.

7. The improved percussive apparatus of claim 6 wherein:

said upper sealing surface is a valving surface for control of supply of pressure fluid from said porting means to said second portion of said piston by way of said recess as a means for accomplishing the timing of overlap and initiation of pressure build up at said opposed end of said piston.

* * * * *